United States Patent [19]

Jennings, Jr.

[11] Patent Number: 5,056,598

[45] Date of Patent: Oct. 15, 1991

[54] METHOD OF PROTECTING CASING DURING HIGH PRESSURE WELL STIMULATION

[75] Inventor: Alfred R. Jennings, Jr., Plano, Tex.

[73] Assignee: Mobil Oil Corporatoin, Fairfax, Va.

[21] Appl. No.: 584,989

[22] Filed: Sep. 20, 1990

[51] Int. Cl.[5] ..... E21B 43/26

[52] U.S. Cl. ..... 166/308; 166/387

[58] Field of Search ..... 166/387, 305.1, 306, 166/307, 308, 177, 242, 243, 380

[56] References Cited

U.S. PATENT DOCUMENTS

| | | | |
|---|---|---|---|
| 4,047,569 | 9/1977 | Tagirou et al. | 166/308 |
| 4,064,941 | 12/1977 | Smith | 166/305.1 |
| 4,067,389 | 1/1978 | Savins | 166/246 |
| 4,378,845 | 4/1983 | Medlin et al. | 166/297 |
| 4,662,831 | 5/1987 | Bennett | 166/280 |
| 4,700,783 | 10/1987 | Baron | 166/373 |
| 4,917,185 | 4/1990 | Jennings, Jr. et al. | 166/281 |

*Primary Examiner*—Terry L. Melius

*Attorney, Agent, or Firm*—Alexander J. McKillop; Charles J. Speciale; Charles A. Malone

[57] ABSTRACT

A method of protecting casing during high pressure well stimulation. An annulus between the casing and tubing is loaded with water via a small volume of nitrogen to partially displace annular fluid down the annulus and up the tubing. This loading takes place prior to setting a packer. Loading in this manner results in a gas "cushion". If the tubing should burst during high pressure stimulation, compression of the "cushion" will prevent the casing from rupturing.

17 Claims, 1 Drawing Sheet

METHOD OF PROTECTING CASING DURING HIGH PRESSURE WELL STIMULATION

FIELD OF THE INVENTION

This invention is directed to a method for protecting a casing from failure during high pressure well stimulation such as hydraulic fracturing.

BACKGROUND OF THE INVENTION

During the course of well drilling operations, a wall of a wellbore being drilled is generally sealed and stabilized by means of a protective steel casing which is lowered through a borehole. Afterwards, the casing is cemented in place after retrieval of the drilling assembly. Setting a steel casing in a well is a time consuming and expensive procedure. To avoid substantial loss of time and expense, it is desired to minimize damage to a well casing during subsequent procedures for producing hydrocarbonaceous fluids from a formation such as high pressure well stimulation. Two such procedures comprise hydraulic fracturing and fracture acidizing. Deep well hydraulic fracturing and fracture acidizing frequently require surface pumping pressures near the burst pressure of a treating pipe or tubing. Usually, when high pressures are required, the tubing/casing annulus is pressurized to some lower pressure. This provides some support on the back side of the tubing. Water is a fluid generally utilized for pressurization along the tubing's back side.

However, there is some risk when using this technique. Should the tubing rupture, a substantial portion of the pressure in the tubing is transferred to the tubing-/casing annulus. Since the larger diameter casing has a lower burst pressure than the tubing, catastrophic failure of the tubing may cause casing failure. Such casing failure will lead to extensive formation damage and expense in repairing said damage.

Therefore, what is needed is a method to prevent casing damage during high pressure well stimulation to avoid extensive down time and substantial expense.

SUMMARY

This invention is directed to a method for protecting casing within a wellbore during high pressure well stimulation. In the practice of this invention, an annular space or annulus, between a casing and a tubing penetrating a formation where hydrocarbonaceous fluids are anticipated to be produced is loaded with a liquid. This liquid is partially displaced down the annulus and up the tubing. To accomplish this, a substantially small volume of gas is utilized. Once the desired amount of gas has been placed in the tubing above the liquid, a packer is set within the wellbore between the casing and the tubing so as to confine the liquid with the gas thereabove in said annular space or annulus.

Being confined in this manner, the gas forms a "cushion" above the liquid. When high pressure well stimulation ruptures the tubing, high pressure is directed through the tubing and into the annular space which forces the liquid up against the gas cushion which causes the cushion to compress. Compression of the cushion allows relaxation of hydraulic forces and thus prevents the generated pressure from contacting and rupturing the casing. In this manner, casing and formation damage is prevented by redirecting high pressure into the annular space instead of through the casing.

It is therefore an object of this invention to provide a well with a protective cushion between the tubing and casing so as to prevent casing failure during high pressure well stimulation.

It is another object of this invention to provide a safe, economical and effective means for protecting a casing during high pressure well stimulation.

It is still yet another object of this invention to provide for a method for protecting a casing during high pressure well stimulation by using those materials commonly found in an oilfield or similar type surroundings.

DESCRIPTION OF THE PREFERRED EMBODIMENT

Figure 1:
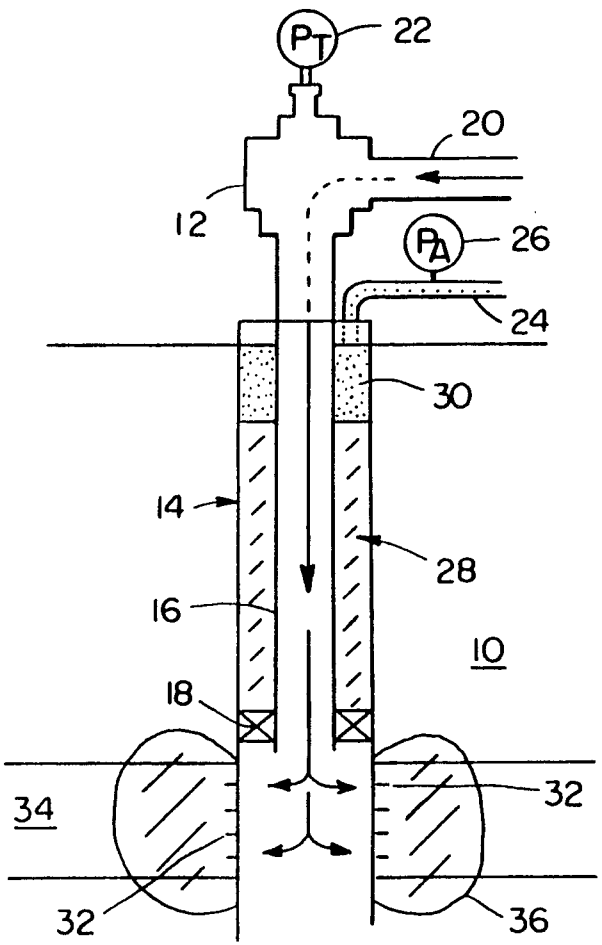
FIG. 1 is a schematic representation of a well which shows the gas cushion in place.

In the practice of this invention, referring to FIG. 1, during a high pressure well stimulation, a fracturing fluid is directed down wellhead conduit 20 into well casing 14 which penetrates formation 10. Prior to commencing this high pressure well stimulation procedure, a liquid, usually water is circulated down annular conduit 24 where it proceeds through an annular space or annulus formed by tubing 16 and casing 14. This water flows up tubing 16 and out through wellhead casing 20. Once the desired amount of water has been placed into the well and in the annular space, circulation of the water is ceased. Afterwards, a substantially small volume of a gas is injected or loaded into said annular space via annular conduit 24. This gas remains above the liquid in the annular space. Once a desired amount of gas has been injected into the annular space above the liquid or annular fluid 28, packer 18 is set between casing 14 and tubing 16. Setting the packer causes the liquid and gas in the annular space or annulus formed between said casing 14 and pipe 16 to be confined therein since a predetermined amount of pressure is applied through annular conduit 24. In this manner, a gas cushion 30 is formed within said annular space above annular fluid 28.

Upon instituting a high pressure well stimulation technique such as hydraulic fracturing, a fracturing fluid is injected into formation 10 via wellhead conduit 20. The injection pressure of the fracturing fluid is monitored by tubing pressure guage 22 which is affixed to wellhead 12. When the injection pressure of the fracturing fluid exceeds the formation fracturing pressure, the fracturing fluid is forced through perforations 32 into a productive interval 34 thereby causing a fracture 36 to form. If the fracturing pressure of the injected fluid exceeds the burst strength of tubing 16, a rupture occurs. This is shown in FIG. 2.

Figure 2:
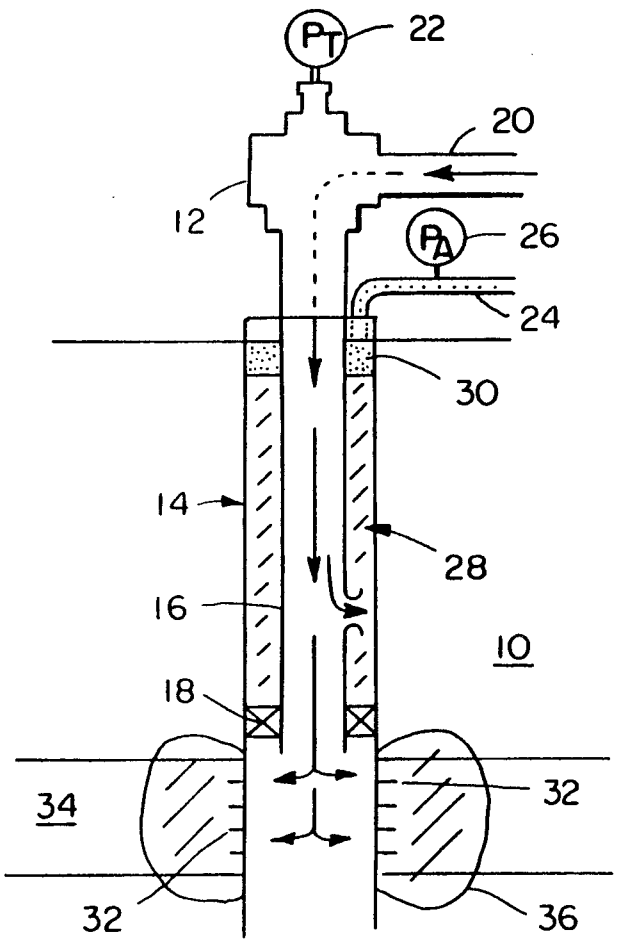
FIG. 2 is a schematic representation of a well which depicts catastrophic tubing failure and a subsequent compression of the gas cushion.

As is shown in FIG. 2, the fracturing fluid has caused a rupture in tubing 16. Once tubing 16 has been ruptured, hydraulic pressure exerted on the fracturing fluid causes the fracturing fluid to enter the annular space occupied by liquid or annular fluid 28. When this occurs, the fracturing fluid causes annular liquid 28 to expand upwardly, thereby compressing gas cushion 30. Compressibility forces are measured by annulus pressure guage 26 which is affixed to annular conduit 24. Since annular fluid 28 increases in pressure, this increased pressure is transmitted to gas cushion 30 thereby absorbing the forces transmitted to said liquid 28.

By absorbing these high pressure forces in liquid 28, casing 14 is relieved from the high pressure which otherwise would have been received due to said rupturing of tubing 16 Therefore, casing 16 remains intact and casing rupture into formation 10 is averted. After an abrupt increase in pressure is observed in the annular space via annular guage 26, injection of fracturing fluid into wellhead conduit 20 is ceased. Thereafter, tubing 16 is removed and replaced with new tubing. Since only the tubing has ruptured, extensive damage is avoided to casing 14, formation 10, and productive interval 34.

An added benefit of this method is that the annular pressure can be controlled by injecting additional water or other liquid into the annulus or annular space during high pressure well stimulation so as to offset the pressure formed while the high pressure stimulation operation is taking place. Liquids which can be utilized in this method comprises sea water, brackish water, or fresh water. Of course, fresh water cannot be used in those formations which are sensitive to fresh water. Liquids which can be utilized in addition to water include "frac" or fracturing fluids, diesel oil and completion fluids (high quality brines, etc.). Gases which can be used in the practice of this invention include carbon dioxide, flue gas, nitrogen, and mixtures thereof.

Hydraulic fracturing is one high pressure well stimulation technique where this invention can be utilized. A hydraulic fracturing technique is discussed in U.S. Pat. No. 4,067,389 which issued to Savins on Jan. 10, 1978. Another method for initiating hydraulic fracturing is disclosed by Medlin et al. in U.S. Pat. No. 4,378,849 which issued on Apr. 5, 1983. Both patents are hereby incorporated by reference. Another high pressure well stimulation technique which can be used is disclosed in U.S. Pat. No. 4,917,185 which issued on Apr. 17, 1990 to A. R. Jennings, Jr. This patent is hereby incorporated by reference herein.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

What is claimed:

1. A method of protecting casing during high pressure stimulation in a well comprising:

(a) loading an annulus or annular space between a casing and tubing in a well with a liquid; and (b) displacing partially the liquid down said annulus and up the tubing with a substantially small volume of gas;

(c) placing a packer in said annular space thereby confining said liquid and gas within the annular space;

(d) instituting high pressure stimulation in said well; and (e) injecting additional liquid into the annular space so as to offset pressure formed while the high pressure stimulation is taking place thereby protecting the casing from rupturing.

2. The method as recited in claim 1 where in step (a) said liquid comprises sea water, brine, brackish water, diesel oil, completion fluids, or fresh water and mixtures thereof.

3. The method as recited in claim 1 where in step b) said gas comprises nitrogen, carbon dioxide, flue gas, and mixtures thereof.

4. The method as recited in claim 1 where in step c) the liquid is confined by a mechanical packer that is set within the annular space while pressure is applied to said gas.

5. A method of protecting casing during high pressure stimulation in a well comprising:

(a) loading an annulus or annular space between a casing and tubing in a well with a liquid;

(b) displacing partially the liquid down said annulus and up the tubing with a substantially small volume of gas; and (c) setting a packer in said annular space between said casing and the tubing but below said liquid and gas thereby confining said liquid and forming a gas "cushion" thereabove which cushion compresses when high pressures rupture the tubing and enter said annular space so as to prevent damage to said casing.

6. The method as recited in claim 5 where in step (a) said liquid comprises sea water, brine, brackish water, diesel oil, completion fluids, or fresh water and mixtures thereof.

7. The method as recited in claim 5 where in step (b) said gas comprises nitrogen, carbon dioxide, flue gas, and mixtures thereof.

8. The method as recited in claim 1 where the high pressure stimulation comprises hydraulic fracturing.

9. The method as recited in claim 1, step (e), where pressure on the tubing during high pressure stimulation causes said tubing to rupture and force liquid in the annulus upwardly against the gas thereby preventing a rupture of the casing.

10. The method as recited in claim 1, step (e), where pressure on the tubing during high pressure stimulation causes said tubing to rupture so as to force liquid in the annulus upwardly against the gas thereby preventing casing rupture, and necessitating tubing replacement only.

11. The method as recited in claim 5, steps (c), where said high pressures result from hydraulic fracturing.

12. The method as recited in claim 5, step (c), where damage prevention to said casing necessitates tubing replacement only.

13. The method as recited in claim 5, step (c), where prior to tubing rupture additional liquid is injected into the annulus to offset pressure generated during high pressure stimulation.

14. A method of protecting casing during high pressure stimulation in a well comprising:

(a) loading an annulus or annular space between a casing and tubing in a well with a liquid selected from a member of the group consisting of sea water, brackish water, brine, fresh water, fracturing fluids, diesel oil, completion fluids, and mixtures thereof;

(b) displacing partially the liquid down said annulus and up the tubing with a substantially small volume of gas selected from a member of the group consisting of carbon dioxide, flue gas, nitrogen, and mixtures thereof; and (c) setting a packer in said annular space between said casing and the tubing but below said liquid and gas thereby confining said liquid and forming a gas "cushion" thereabove which cushion compresses when high pressures rupture the tubing and enter said annular space so as to prevent damage to said casing during high pressure stimulation.

15. The method as recited in claim 14 where the high pressure stimulation comprises hydraulic fracturing.

16. The method as recited in claim 14 where prior to tubing rupture additional liquid is injected into the annulus to offset pressure generated during high pressure stimulation.

17. The method as recited in claim 14 where damage prevention to said casing necessitates tubing replacement only.

* * * * *